United States Patent [19]

Lan

[11] Patent Number: 4,692,046

[45] Date of Patent: Sep. 8, 1987

[54] PEN WITH SELECTIVE MULTI-COLOR CORES

[76] Inventor: Charng-Ching Lan, No. 18, Sec. 1 Yuan Lin Road, Ta Hsi Chien, Taoyuan Hsien, Taiwan

[21] Appl. No.: 843,913

[22] Filed: Mar. 20, 1986

[51] Int. Cl.[4] ..... B43K 24/06; B43K 24/14

[52] U.S. Cl. ..... 401/32; 401/33

[58] Field of Search ..... 401/32, 33, 29

[56] References Cited

U.S. PATENT DOCUMENTS

| | | | |
|---|---|---|---|
| 3,299,857 | 1/1967 | Sears | 401/33 |
| 4,359,291 | 11/1982 | Lum | 401/33 |

FOREIGN PATENT DOCUMENTS

| | | | |
|---|---|---|---|
| 2531604 | 2/1977 | Fed. Rep. of Germany | 401/32 |
| 965615 | 9/1950 | France | 401/33 |
| 59263 | 5/1954 | France | 401/33 |
| 444447 | 1/1949 | Italy | 401/33 |
| 518042 | 3/1955 | Italy | 401/33 |

*Primary Examiner*—Steven A. Bratlie

*Attorney, Agent, or Firm*—Browdy and Neimark

[57] ABSTRACT

A pen containing multi-color cores located in different tubes housed in the pen body, which colors can be optionally selected for use readily using a specially-designed turnable knob having a projected edge in cam contact with the top end of the core-receiving tubes. The top end of the core-receiving tube is pushed downward for use, when the turnable knob is rotated, so to enable a person to select a color core as he wishes quickly and readily.

1 Claim, 7 Drawing Figures

PEN WITH SELECTIVE MULTI-COLOR CORES

FIELD OF THE INVENTION

The present invention relates to a multi-color marking pen having a number of core-receiving tubes housed in a hollow pen equipped with a turnable knob on the top end. The knob consists of two cylindrical portions of different diameters, having a projected edge on the circumference of the bottom end thereof. The projected edge, in cam contact with the smoothly cornered three-faceted top end of a core-receiving tube, can push the tube downward for allowing a selected color core, which is received in a tube, to project from a core outlet for use.

BACKGROUND OF THE INVENTION

Marking on articles, books, magazines or newspapers has become a very routine necessity in every day, and it is not convenient to carry along several pens of different colors for use on different locations.

SUMMARY OF THE INVENTION

The inventor, viewing the deficiency with the general mark pen and the inconvenience caused by the necessity of using different colors to mark papers, has devoted his time to designing a multi-color pen, with colors selectively available one at a time, and made it commercially practical after many tests and improvements.

The prime object of the present disclosure is to provide a marking pen of multiple colors selectively available one at a time by adopting a turnable knob disposed on the top end of the pen body, which knob has a cylindrical portion on the bottom thereof, having a projecting edge on the bottom circumference so that said turnable knob can be engaged with the top ends of the core-receiving tubes housed in the pen embodiment, one by one, for achieving a selection purpose when the knob is rotated.

The further object of the present disclosure is to provide a marking pen having a hollow body for housing a number of core-receiving tubes, which body is designed to have elongated projected tube-holding contours on the inner wall thereof so that the core-receiving tubes can be held firmly therein for ensuring a confined movement of the tubes as well as the attached cores therein without shifting out of place when used.

The further object of the present disclosure is to provide a marking pen having multiple color cores for selection, which is designed to have a bottom end so shaped that the user is able to view the writings on the paper while marking.

For better demonstrating the characteristics and the modes of operation, the accompanying drawings are provided:

DETAILED DESCRIPTION

Figure 1:
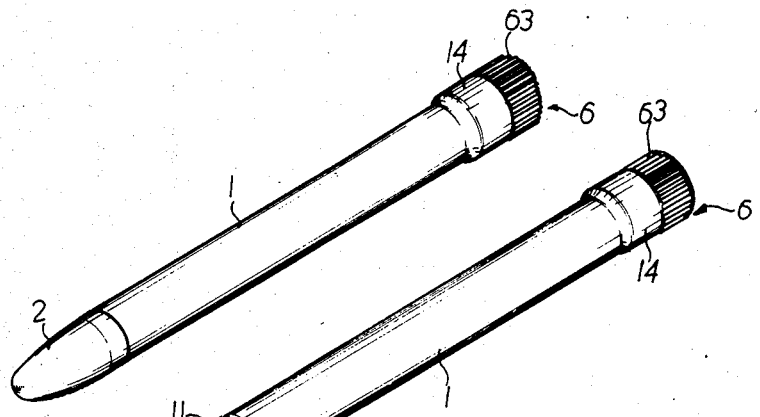
FIG. 1 is a perspective view of the pen of the present invention having a bullet-like cap.
Figure 2:
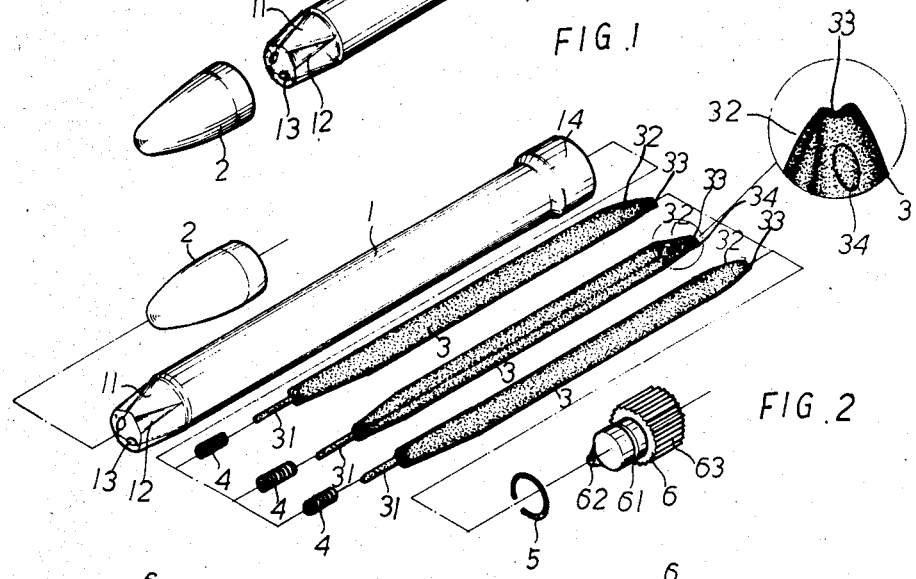
FIG. 2 is an exploded diagram of FIG. 1.
Figure 5:
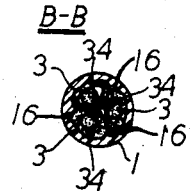
FIG. 5 is a sectional view taken at A–B.
Figure 6:
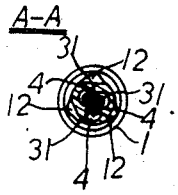
FIG. 6 is a sectional view taken at A—A.

Referring to FIG. 1, FIG. 2, the marking pen is comprised of a pen body 1, a bullet-like cap 2, core-receiving tubes 3, springs 4, an opened ring 5, a turnable knob 6, wherein the bottom end 11 of said pen body is cone-shaped, with the oblique side planes cut into a number of triangular facets 12 and C core outlets 13 are symmetrically disposed at the right bottom of the bottom end of the pen, the bottom end is so shaped in consideration of providing the user a better viewing angle in marking. The core-receiving tubes are shaped with their sectional area in oval-like form as shown in FIG. 5 and their top end obliquely and smoothly cut into three facets as shown at 32 with the topmost end cut in a groove 33 for engagement of the projected edge 62 to enable the user to select the right core for use. The hollow interior of said tube 3 is filled with fluid absorbent material for storing the necessary ink for use which can be charged in the said tube from the ink-charging hole 34. The turnable knob 6, having a projected edge 62 disposed on the circumference of the bottom side, has its outer surface denticulated for easy operation of the knob without slipping, and a recessed groove 61 is partially disposed around the cylindrical portion under said denticulated knob for receiving an opened ring 5 which is also partially wedged in a recessed groove 15 on the inner wall of the pen embodiment 1 at the top end 14 so that the turnable knob is firmly disposed thereon and smoothly rotatable as a whole.

Figure 3:
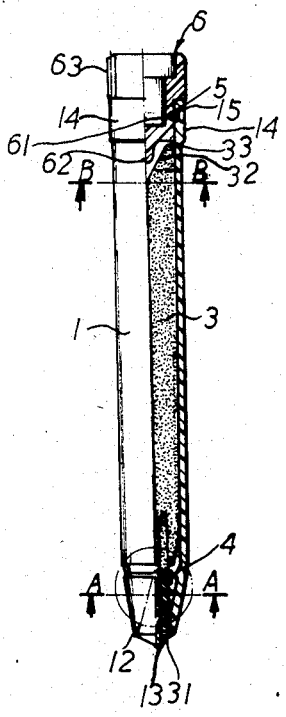
FIG. 3 is a sectional view of FIG. 3.
Figure 4:
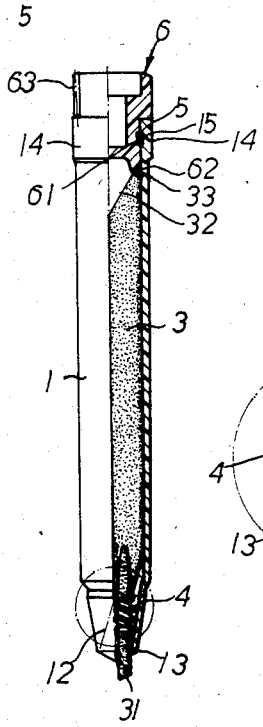
FIG. 4 is a sectional view of FIG. 1 with a core projecting from the pen.
Figure 7:
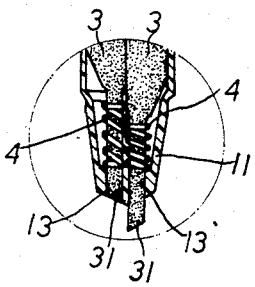
FIG. 7 is an enlarged view of the bottom end of the pen body.

Referring now to FIGS. 3 and 4, the marking pen of the present invention is assembled beginning with the disposition of springs 4 at the bottom end of the pen body 1 in juxtaposition to each other, right on the core outlets 13, which can be placed firmly in position because of the cone shaped end (as shown in FIG. 7) next the core-receiving tubes, with their front cores positioned in said springs and their oval-like shafts embraced by the symmetrically elongated tube-holding projections 16 on the inner wall of the pen body 1 and in close contact with each other, can be pushed downward smoothly and steadily without slipping out of place, and the turnable knob 6 is placed with an opened ring 5 partially placed in the recessed groove 61 on the cylindrical projection under said knob 6 and partially wedged in the recessed groove 15 on the inner wall of said pen body near the top end thereof so that the denticulated turnable knob 6 becomes confinedly rotatable accordingly.

Referring to FIGS. 3, 4, 6 and 7, the multiple core-receiving tubes 3 disposed in the pen body 1 are in a releasing relationship with said turnable knob 6 as shown in FIG. 3 when not used, with the projected edge 62 of the turnable knob 6 standing by in the remaining space between the top ends of the tubes 3, and the springs 4 at the bottom end push the tubes upward along with the cores so that the cores are not projecting out of core outlets 13 for use. When the turnable knob 6 is rotated, the projected egde 62 begins to come into cam contact with one of the properly contoured top end of said core-receiving tubes 3, with the said tubes moving gradually downward untill said edge reaches and dwells on the top of said tube 3 in a small groove 33 thereon. In the meantime, the spring 4 is compressed for allowing the core to project out of the corresponding core outlet 13 at the bottom end 11 of said pen body 1 for use.

The cores of different colors moving in and out in an individual outlet 13 are separated from each other by the tubes 3 into which ink of various colors can be charged. Because of the separation of the cores, it is not possible for the inks to be mixed up as shown in FIGS. 4 and 7. One can freely select different ink as he wishes to charge into the tubes for use from a ink-charging hole 34.

When the marking pen is not in use, the turnable knob 6 is turned for releasing the downwardly pushed tube from the compression of said projected edge 62, which moves upward owing to the resilient force of the compressed spring 4. In the meantime, the projected edge 62 moves out of the small groove 33 and slides away from the tube 3 along the smoothly contoured side facet of the top end so to allow the projecting core to retract into the pen body along with the tube 3. A bullet-like cap 2 is adapted to protect the cores from being dried up at the bottom 11 of the pen embodiment. The spring force is designed to be sufficiently small so that the turnable knob 6 will not be separated from the pen body 1 because of exertion of the spring forces.

The present merits of the invention become apparent through the proceeding description, in the practicality of choosing from a variety of colors, the compact size for easy carrying, easy operation, better protection from ink being mixed up, and low cost.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A marking pen with a plurality of colored cores comprising:

a pen body comprising a hollow tube having a top end, a bottom end, an inner wall, and an outer wall, and a plurality of elongated tube-holding projections on the inner wall of the pen body;

a recessed groove at the top end of said pen body;

the bottom end of said pen body being cone-shaped and comprising a plurality of core outlets on the exterior thereof;

a pluriality of core-receiving tubes housed in said pen body, in the tube-holding projections, each tube having an oval cross-section and a smooth three-faceted top end, a small groove on the topmost end thereof, and a hollow interior containing fluid-absorbent material for storing ink, and a core at the bottom end;

a spring removably disposed on the bottom end of each of said core-receiving tubes;

a turnable knob comprising a top cylindrical portion and a bottom cylindrical portion, the top portion and bottom portion having differing diameters, the top portion thereof being denticulated externally, and a groove disposed on the bottom portion thereof;

an opened ring located partially on the bottom portion of said knob and partially in a recessed groove on the inner wall of said pen body;

a projecting edge on the circumference of the bottom end of said knob which is in cam engagement with the three-faceted cam surface on the top of a core-receiving tube to enable the tube to be pushed downwardly to allow the core to project out of said core outlets;

a cap attached to the bottom end of said pen body.

* * * * *